United States Patent [19]

Corlett

[11] Patent Number: 5,070,802

[45] Date of Patent: Dec. 10, 1991

[54] VANG ASSEMBLY FOR SAILBOATS

[76] Inventor: Edwin H. Corlett, c/o Corlett & Associates, 110 W. Madison St., Oak Park, Ill. 60302

[21] Appl. No.: 636,887

[22] Filed: Jan. 2, 1991

[51] Int. Cl.[5] ..... B63H 9/10

[52] U.S. Cl. ..... 114/99; 114/98; 114/102; 267/164

[58] Field of Search ..... 114/39.1, 98, 99, 102, 114/103, 104, 105, 111, 112, 215, 223; 267/158, 264

[56] References Cited

U.S. PATENT DOCUMENTS

| | | | |
|---|---|---|---|
| 3,142,282 | 7/1964 | Nichols | 114/102 |
| 3,396,689 | 8/1968 | Sommer | 114/98 |
| 4,261,276 | 4/1981 | Darzinskis | 114/104 |
| 4,406,240 | 9/1983 | Andersen | 114/99 |
| 4,630,564 | 12/1986 | Dackman et al. | 114/99 |
| 4,723,498 | 2/1988 | Stampe | 114/102 |
| 4,924,793 | 5/1990 | Pritchard | 114/102 |

OTHER PUBLICATIONS

Henkel, Steve, "Mechanical Vangs", Sail Magazine, pp. 99–103, (Jan. 1990).

Sailing World Magazine, p. 47, (Jan., 1988).

Henderson, Richard, *Understanding Rigs and Rigging*, pp. 146–147.

*Primary Examiner*—Sherman Basinger

*Assistant Examiner*—Thomas J. Brahan

*Attorney, Agent, or Firm*—Wood, Phillips, Mason, Recktenwald & VanSanten

[57] ABSTRACT

A vang assembly is provided for manipulating a sailboat boom. The vang assembly includes a mechanical vang in the form of a resiliently flexible elongate column provided with an adjustment means in the form of a soft vang for arcuately flexing the mechanical vang. Opposite ends of the mechanical vang are attached below the boom to a lower portion of the mast and to the boom at a location spaced outwardly and upwardly from the lower portion of the mast. The adjustment means is attached to opposite ends of the mechanical vang and is movable between a contracted position and an extended position. When the adjustment means is moved to a contracted position, the mechanical vang is bowed arcuately upwardly and the boom is urged in a downward direction. When the adjustment means is moved to extended position, the arcuately bowed mechanical vang straightens and pushes the boom upwardly.

20 Claims, 3 Drawing Sheets

VANG ASSEMBLY FOR SAILBOATS

BACKGROUND OF THE INVENTION

1. Technical Field

The present invention is directed toward sailboat rigging, and more particularly toward a vang assembly for manipulating the boom of a sailboat.

2. Background Art

A vang ("kicking strap" to the British) is an adjustable rigging fitted to the underside of a boom to control the raising or lowering of the boom in changing wind conditions.

Vangs are well known in sailing rigging art, and can be divided into three basic types: (1) soft vangs, (2) hydraulic vangs and (3) mechanical vangs. The oldest and most widely used vangs are soft vangs. A soft vang is used to limit twist in a mainsail by placing the mainsail's leech in tension. When a mainsail is eased in medium or heavy air, the boom will lift and the leech will twist and spill wind. Too much twist and the resulting spill of wind reduces the efficiency of the sail and slows the boat. Thus, a soft vang increases sail efficiency by pulling down on the boom in medium or heavy air, thereby increasing the tension in the leech and reducing the spill of wind.

The traditional soft vang is a multi-part rope or wire tackle rigged from the mast base to the underside of the boom with the rope or wire (known as the "fall" in sailing parlance) either secured to a cleat at the mast base or led aft along the cabin top to the cockpit. Soft vangs are generally simple and relatively inexpensive to assemble and install. They are generally used on small and medium size boats.

While soft vangs are extremely effective in maintaining tension in the leech, they have serious limitations. Most importantly, soft vangs may only be used to pull down on the boom. Thus, in slight winds or when docked, a wire or rope topping lift must be used to support the boom. Use of a topping lift is extremely undesirable because it increases the wind drag of the sailboat and has a tendency to chaff the leech.

Hydraulic vangs represent an improvement over soft vangs in that they may both pull down on the boom and hold up the boom, thus eliminating the need for a wire or rope topping lift. Hydraulic vangs typically consist of a cylinder filled with hydraulic oil and a piston. A hydraulic pump controlled from the cockpit actuates the piston inward or outward to control the height of the boom.

Although hydraulic vangs have some advantages over a soft vang (most notably, the ability to hold up the boom) they also have numerous serious drawbacks. First, hydraulic vangs operate under high pressure and therefore require heavy, precisely machined components. Thus, hydraulic vangs are both heavy and expensive. Second, hydraulic vangs are difficult to install, requiring numerous hydraulic connections and conduits. Third, because the vangs are used in a hostile environment, hydraulic vangs must be carefully lubricated and maintained to avoid corrosion and failure. Finally, because of their weight and expense, hydraulic vangs are generally unsuitable for sailboats under 36 feet.

Mechanical vangs are typically similar in appearance to hydraulic vangs but are actuated by mechanical, rather than hydraulic, means.

There are two varieties of mechanical vangs. The first variety is a tackle-equipped rigid vang. These vangs generally comprise a set of telescoping springloaded aluminum tubes with a tackle rigging longitudinally associated therewith. When the tackle rigging is tightened, it applies a downward force on the boom and compresses the spring within the telescoping aluminum tubes. As the rigging is loosened, the spring within the telescoping aluminum tubes extends, thus providing support for the boom. Typically, the spring comprises a steel coil; however, compressed-gas cylinder springs are also used.

Tackle-equipped rigid vangs have several serious problems. As with hydraulic vangs, the telescoping tubes must be carefully maintained to avoid corrosion. In addition, if water is allowed to leak into the telescoping tubes, the metal springs may be particularly subject to corrosion. Moreover, the vangs have the undesirable characteristic of squeaking upon slight bobbles at anchor because of the friction between the inside and the outside tube or the spring and the tubes. The telescoping springloaded tubes of these vangs must also be carefully machined, making them relatively expensive. Finally, these vangs are susceptible to denting and bending from transverse forces. Such damage inhibits the telescoping of the tubes, degrading the vang's performance.

The other variety of mechanical vangs are screw-driven or "rotary" vangs. In a screw-driven vang, a large turnbuckle is lengthened or shortened by turning a wheel or a pair of handles in the middle of the turnbuckle. Although capable of providing both tension in the leech and supporting the boom, screw-driven vangs have the serious disadvantage of being difficult and slow to adjust because of their heavy nature.

The present invention is directed toward overcoming one or more of the problems with the prior art discussed above.

SUMMARY OF THE INVENTION

The present invention provides a mechanical vang which is inexpensive to manufacture, durable, resistent to corrosive elements encountered while sailing, lightweight, susceptible to a minimal amount of wind drag, quiet in operation, maintenance free and readily adjustable both in length and spring resistance.

In one aspect of the present invention, a vang assembly is provided for manipulating a sailboat boom which is pivotably connected to the lower portion of a sailboat mast. The vang assembly includes an elongate column which is flexibly resilient transverse to its longitudinal axis. The column has first and second opposite end portions. The first end portion is swingably attached to the lower portion of the mast below the boom, and the second end portion is swingably attached to the boom at a location spaced outwardly from the lower portion of the mast. An adjustment device is positioned longitudinally of the column and attached to the opposite end portions of the column. The adjustment device is capable of being moved between a contracted position and an extended position. When the adjustment mechanism is moved to a contracted position, the column is forced to bow arcuately to an arched position and the boom is forced and urged in a downward direction. When the adjustment mechanism is released to extended position, the arcuately bowed column straightens and exerts forces pushing the boom upwardly.

The vang assembly includes means for increasing and varying the stiffness of the column; that is, the resistance of the column to bending forces may be varied. In addition, the length of the column may be increased or decreased so that the vang assembly can be used on sailboats of varying sizes and lengths.

The resiliently flexible column of the invention is actually a substantially constant force spring. In accordance with well-known principles relating to such springs, as long as not overstressed, columnar constant force springs exert a substantially uniform force between the mast and boom when moving toward straightened condition. This function cannot be provided by compression type coil springs which are governed by different physical principles.

Still other aspects, objects and advantages of the present invention can be obtained from a study of the specification, the drawings and the appended claims.

DESCRIPTION OF THE PREFERRED EMBODIMENT

Figure 1:
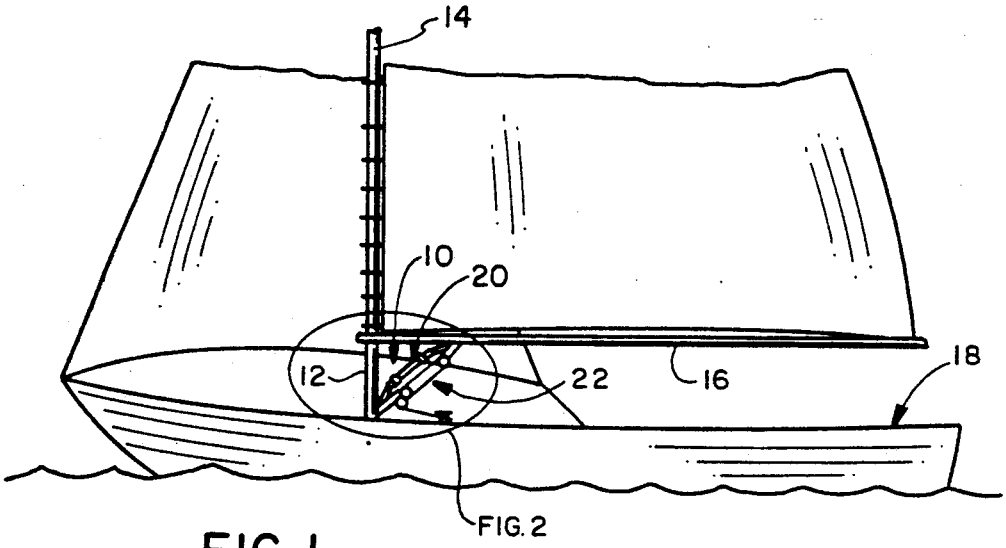
FIG. 1 is an elevational view of a sailboat with the mechanical vang of the present invention disposed thereon.

A vang assembly, generally designated 10, of the present invention is shown in FIG. 1 positioned between a lower portion 12 of a mast 14 and a boom 16 of a sailboat 18. The vang assembly broadly includes a mechanical vang, generally designated 20, and an adjustment means in the form of a soft vang, herein a block and tackle assembly, generally designated 22, extending longitudinally of the vang 20, and attached thereto at the opposite end portions of the vang 20. In unflexed condition, the mechanical vang 20 is inclined from the mast to the boom preferably at an angle ranging from 30° to 45°.

Figure 2:
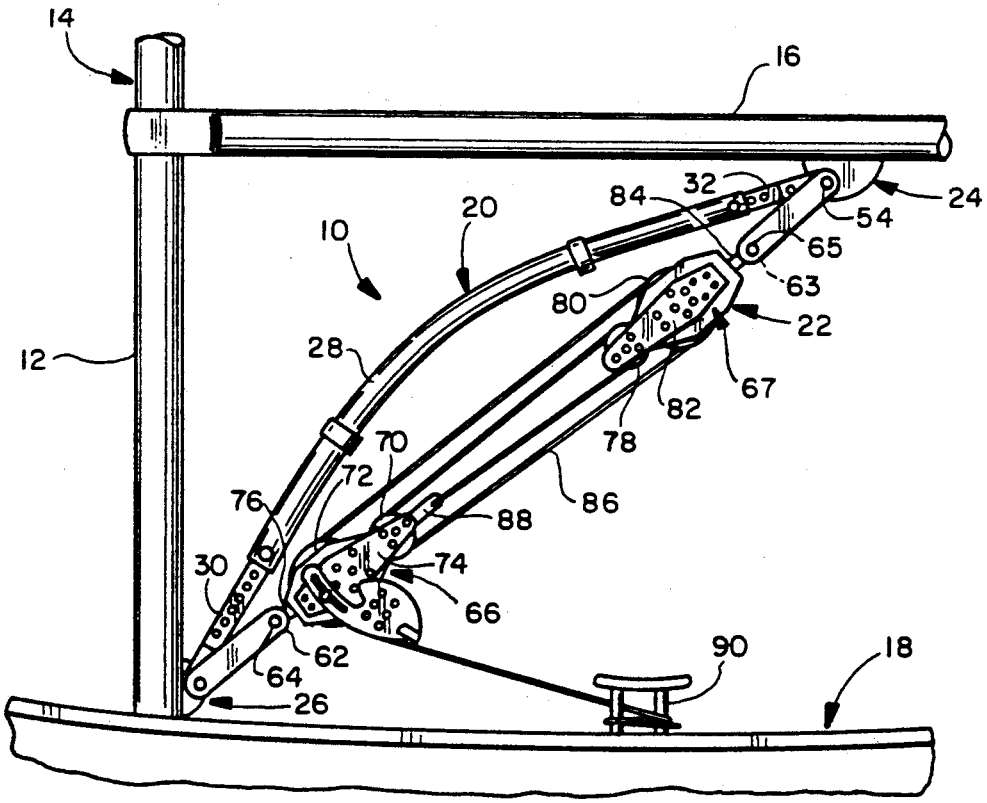
FIG. 2 is an enlarged side elevational view of the mechanical vang of the present invention disposed between the mast and the boom of a sailboat as indicated in FIG. 1.

In operation, as best shown in FIG. 2, the vang 20 is swingably attached to the underside of the boom 16 at 24 and similarly attached to the aft side of the lower portion of the mast 14 at 26. When the block and tackle assembly is adjusted from its extended position to its contracted position (FIG. 2), the vang 20 is cocked or flexed arcuately to its arched position and downward forces are exerted on the boom 16 and the leech of the sail. When the block and tackle assembly is adjusted or released to its extended position, the vang 20 is released from its arched position and exerts upward forces on the boom 16. Thus, the released vang 20 gives upward support to the boom 16 when the sail 19 will not support the boom as at anchor or with inadequate wind.

Figure 3:
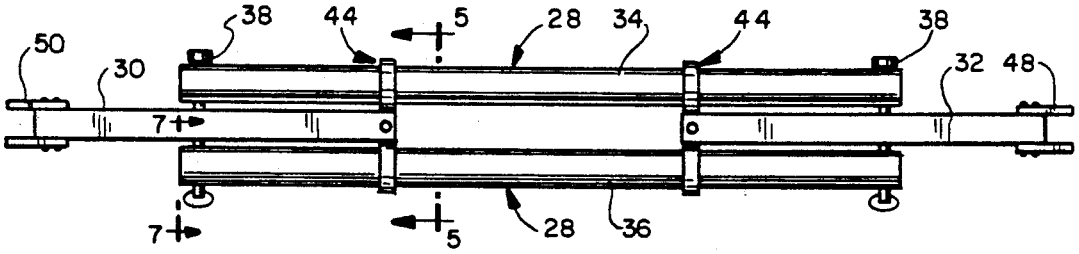
FIG. 3 is a top plan view of the mechanical vang of the present invention.
Figure 4:
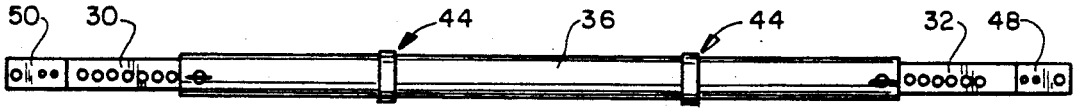
FIG. 4 is a side elevational view of the unbent column mechanical vang of the present invention.
Figure 8:
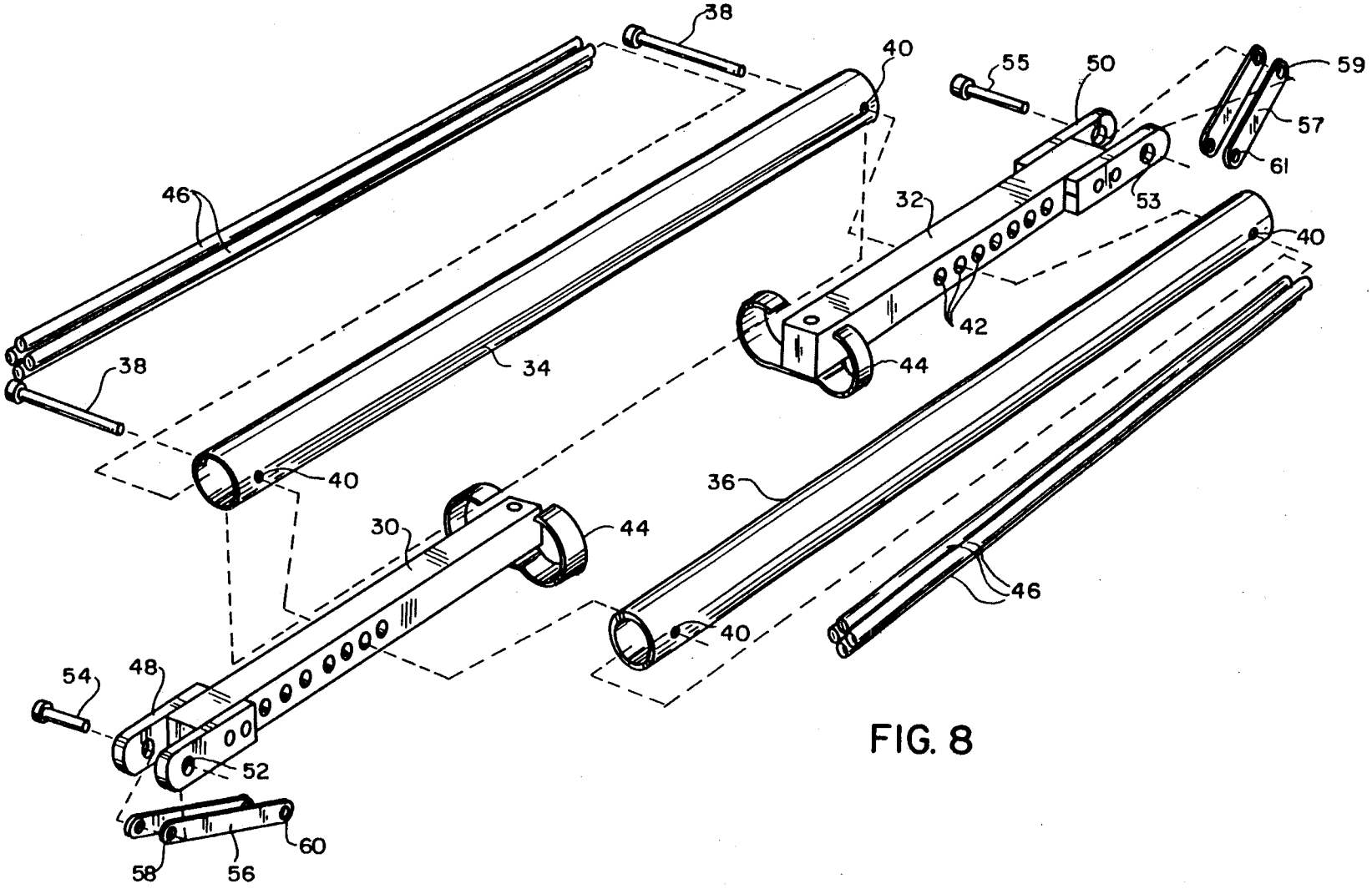
FIG. 8 is an exploded view of the mechanical vang of the present invention.

The mechanical vang is best shown in FIGS. 3, 4 and 8. It is formed and constructed to provide the mechanical property of resilient flexibility. Thus, when it is flexed or cocked to arched position, it will always tend to return toward a linear position (FIG. 4) when released from the flexing force.

As herein shown, the vang 20 is in the form of a resiliently flexible elongate member or column 28 having first and second opposite end portions or extension assemblies 30, 32. The column 28 preferably includes two juxtaposed elongate resiliently flexible hollow tubes or shells 34, 36 of polycarbonate plastic material sold under the trademark Lexan. Other durable plastic materials may be used having similar physical properties such as polyvinyl chloride. The proximal and distal ends of each of the juxtaposed tubes are held in spaced relation by the first and second end portions 30, 32 being interposed there between and flexibly secured thereto by headed pins 38 passing through aligned apertures 40 in the tubes and one of a plurality of apertures 42 in the extension assemblies. The pins 38 may take many forms, such as cotter pins, and are removable for purposes later to be discussed.

Figure 5:
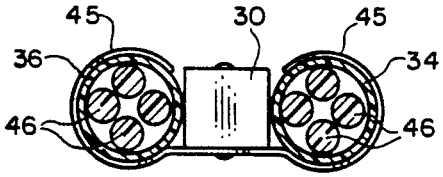
FIG. 5 is a sectional view of the mechanical vang of the present invention taken along line 5—5 of FIG. 3.
Figure 6:
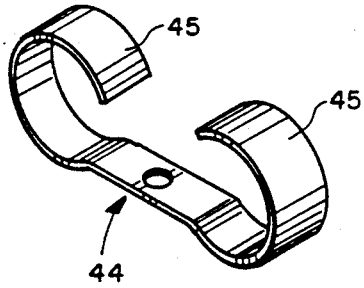
FIG. 6 is a perspective view of one of the guide portions of the present invention.

Means are provided to vary the length of the resiliently flexible column 28 to afford varying spring forces from the column 28 and to accommodate the booms and sails of sailboats of varying lengths. As herein shown, each extension assembly 30, 32 is preferably provided with a spring guide 44 attached conventionally to the inner end of each extension assembly 30, 32. As best seen in FIGS. 5 and 6, each spring guide preferably includes upwardly and inwardly directed opposed loops 45 which slidably embrace and partially surround the proximal and distal ends of each of the tubes 34, 36. The guides bear against and support the underside of the tubes during flexing and also provide limited sliding movement between the guides and tubes during flexure of the tubes.

As pointed out above, a plurality of apertures 42 are formed longitudinally of each of the extension assemblies 30, 32. By removing either of the pins 38, each extension assembly may be moved toward or away from each of the tube ends because of the slidable embrace between the spring guides and the tubes. Thus, the column 28 may be shortened or lengthened at each of its ends by selecting and aligning one of the apertures 42 with tube apertures 40 and then replacing the pin 38.

Figure 7:
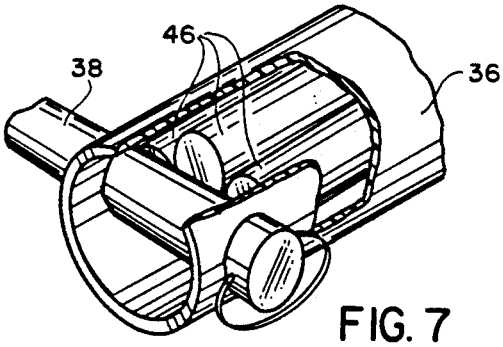
FIG. 7 is a perspective view partly in section as taken along lines 7—7 of FIG. 3 illustrating resiliently flexible rods secured in a tube member.

Means are also provided herein for varying the stiffness or resistance to flexing forces of the elongate member or column 28. To this end, one or a number of elongate resiliently flexible rods 46 are provided for insertion in each of the hollow plastic tubes 34, 36, as illustrated in FIGS. 5, 7 and 8. The rods 46 are preferably formed of fiber-glass although other materials exhibiting similar physical properties may be employed. The same number of substantially identical rods 46 is preferably inserted in each of the tubes 34, 36 as shown in FIG. 5. By augmenting or subtracting from the potential energy stored in the flexed column 28 (increasing or decreasing the number of rods used), the column can be adapted to exert greater or lesser forces between the mast 14 and the boom 16. This feature permits the vang assembly 10 to be adapted for use with a number of varying sizes of booms and sailboats.

Abutment means are provided in each of the hollow tubes 34, 36 to releasably retain the rods 46 within each of the tubes. As illustrated in FIG. 7, the transverse pin 38 which unites the hollow tubes 34, 36 with the extension assemblies 30, 32 also restricts the open end of each tube and retains the rods 46 within the tubes during operation of the vang assembly 10. While pins 38 preferably function as abutment means or stops, other abutments or stops may be used within the scope of the present invention.

The free ends of each of the extension assemblies 30, 32 are provided with a clevis 48, 50 each having aligned holes 52, 53. The mast fitting at 26 is a conventional pivoting fitting which provides swinging movement generally in a horizontal plane to permit the vang assembly 10 to swing arcuately with the boom 16. The clevis 48 is attached to the mast fitting by a clevis pin 54 which permits the vang assembly 10 to also swing in a generally vertical plane. Thus, the mast fitting and its attachment to the clevis 48 affords a universal joint permitting free horizontal and vertical movement of the vang assembly 10.

As best seen in FIG. 2, a conventional boom fitting at 24 is secured to the underside of the boom 16. The clevis 50 embraces the boom fitting and is flexibly and swingably secured thereto by clevis pin 55 passing through aligned holes 53 and an opening in the fitting to provide swinging movement between the boom and the vang assembly generally in an upright or vertical plane. A pair of double links 56, 57 are also swingably connected to each clevis 48, 50 (FIGS. 2 and 8) for joinder with an end of the block and tackle assembly 22.

As herein shown, clevis pins 52, 53 respectively each pass through apertured ends 58, 59 of the double links 56, 57 to swingably retain the pair of double links upon each clevis pin 54, 55. Free apertured ends 60, 61 of each of the double links are in turn flexibly and swingably secured to each of the apertured opposite ends 62, 63 of the block and tackle assembly 22 by link pins 64, 65 to secure and position the soft vang 22 between opposite ends of the mechanical vang 20.

The block and tackle assembly 22 or soft vang is best shown in FIG. 2. As pointed out above, the block and tackle assembly is the adjustment means for arcuately flexing the mechanical vang 20. As the vang 20 is flexed into arched position, the block and tackle assembly 22 is spaced from the parts of the mechanical vang 20 in much the same manner as the string of an archer's bow.

The conventional block and tackle assembly 22 includes a fixed block 66 and a movable block 68. The fixed block 60 has a first sheave 70 and a second sheave 72 rotatably secured within a housing or shell 74. The block 66 is flexibly joined to links 56 and link pin 64 by shackle 76 extending outwardly of the block 66.

The movable block 68 includes a first pulley 78 and a second pulley 80 rotatably secured within a pulley housing or shell 82. The pulley housing 82 is flexibly secured to links 57 and link pin 65 by shackle 84 in the same manner as the securement of the sheave housing 74.

As readily understood by those skilled in the art, a rope or wire 86 is secured at one end to a thimble 88 on fixed block 66 and passes around sheave 70, 72 and pulley 78, 80 in a well-known manner. When the rope is advanced through the block and tackle assembly to arcuately flex the mechanical vang 20, the adjustment means is moved from its extended position to its contracted position and the free end of the rope is attached to a cleat 90 on the sailboat to retain the vang 20 in its arched position.

The vang assembly of the present invention has the advantages of hydraulic vangs and mechanical vangs because it can function not only to provide tension in the leech, but also to support the boom and thereby render unnecessary the use of a wire or rope topping lift typically associated with soft vangs. The device is lightweight, durable and inexpensive to manufacture; it may be installed using conventional rigging hardware; and it is formed of corrosion resistant materials requiring little or no lubrication or other maintenance to perform reliably.

While in the foregoing there has been set forth a preferred embodiment of the invention, it will be appreciated that the details herein given may be varied by those skilled in the art without departing from the true spirit and scope of the appended claims.

I claim:

1. A vang assembly for manipulating a sailboat boom pivotally connected to the lower portion of a sailboat mast, comprising:

a resiliently flexible elongate member having first and second opposite end portions, the first end portion having first attachment means for swingable connection to the lower portion of the mast below the boom and the second end portion having a second attachment means for swingable connection to the boom at a location spaced outwardly and upwardly from the first attachment means; and adjustment means extending longitudinally of the elongate member and connected to the first and second end portions, the adjustment means being movable between a contracted position and an extended position, whereby movement of the adjustment means to contracted position exerts forces bowing the elongate member into an arched position and urging the boom in a downward direction, and movement of the adjustment means to extended position releases the downwardly directed force on the boom and further releases the elongate member from its arched position to exert an upward force on the boom.

2. A vang assembly as specified in claim 1 in which the adjustment means is a block and tackle assembly.

3. A vang assembly as specified in claim 1 in which one of the opposite end portions is adjustably secured to the elongate member to vary the length of the elongate member.

4. A vang assembly as specified in claim 1 in which each of the opposite end portions is adjustably secured to the elongate member to vary the length of the elongate member.

5. A vang assembly as specified in claim 1 in which the elongate member is a resiliently flexible elongate tube.

6. A vang assembly as specified in claim 1 in which the elongate member includes a resiliently flexible elongate hollow tube provided with an elongate resiliently flexible rod positioned in the tube to augment the force required to move the elongate member to its arched position.

7. A vang assembly as specified in claim 6 in which the hollow tube is formed of polyvinyl plastic and the elongate rod is formed of fiberglass.

8. A vang assembly as specified in claim 6 in which a plurality of resiliently flexible elongate rods are positioned in the hollow tube.

9. A vang assembly as specified in claim 7 in which abutment means are provided in the hollow tube to retain the rods within the tube.

10. A vang assembly for manipulating a sailboat boom pivotally connected to the lower portion of a sailboat mast, comprising:

a resiliently flexible elongate member having first and second opposite end portions, the first end portion having attachment means for connection to the lower portion of the mast below the boom and the second end portion having second attachment means for connection to the boom at a location spaced outwardly and upwardly from the first attachment means, the elongate member being formed of two juxtaposed elongate resiliently flexible hollow tubes and said first and second end portions, the tubes having proximal and distal ends each held in spaced relation by the first and second end portions being interposed therebetween and secured thereto; and adjustment means extending longitudinally of the elongate member and connected to the first and second end portions, the adjustment means being movable between a contracted position and an extended position, whereby movement of the adjustment means to contracted position exerts forces bowing the elongate member into an arched position and urging the boom in a downward direction, and movement of the adjustment means to extended position releases the downwardly directed force on the boom and further releases the elongate member from its arched position to exert an upward force on the boom.

11. A vang assembly as specified in claim 10 in which the adjustment means is a block and tackle assembly.

12. A vang assembly as specified in claim 10 in which one of the opposite end portions is adjustably secured to one of the adjacent ends of the hollow tube to vary the length of the elongate member.

13. A vang assembly as specified in claim 10 in which the first end portion is adjustably secured to the proximal ends of the hollow tubes and the second end portion is adjustably secured to the distal ends of the hollow tubes to vary the length of the elongate member.

14. A vang assembly as specified in claim 10 in which a resiliently flexible elongate rod is positioned in each of the hollow tubes to augment the force required to move the elongate member to its arched position.

15. A vang assembly as specified in claim 14 in which abutment means are provided in each of the hollow tubes to retain each of the rods within each of the tubes.

16. A vang assembly as specified in claim 10, in which each of the hollow tubes is similarly shaped and each is formed from polyvinyl chloride plastic.

17. A vang assembly as specified in claim 10 in which a plurality of resiliently flexible elongate rods are positioned in each of the hollow tubes to augment the force required to move the elongate member to its arched position.

18. A vang assembly as specified in claim 10, in which each of the hollow tubes is formed of polyvinyl chloride plastic, and a resiliently flexible elongate rod of fiberglass is positioned in each of the hollow tubes to augment the force required to move the elongate member to its arched position.

19. A vang assembly as specified in claim 10, in which the first end portion includes a guide formed to slidably embrace the proximal ends of the hollow tubes and the second end portion includes a second guide formed to slidably embrace the distal ends of the hollow tubes, said end portions and guides retaining the tubes in juxtaposed position during flexure.

20. A vang assembly for manipulating a sailboat boom pivotally connected to the lower portion of a sailboat mast, comprising:

a mechanical vang including a resiliently flexible elongate member having first and second opposite end portions, the first end portion having first attachment means for swingable connection to the lower portion of the mast below the boom and the second end portion having a second attachment means for swingable connection to the boom at a location spaced outwardly and upwardly from the first attachment means; and a soft vang extending longitudinally of the mechanical vang and connected to the first and second end portions, the soft vang being movable between a contracted position and an extended position, whereby movement of the soft vang to contracted position exerts forces bowing the elongate member into an arched position and urging the boom in a downward direction, and movement of the soft vang to extended position releases the downwardly directed force on the boom and further releases the elongate member from its arched position to exert an upward force on the boom.

* * * * *